United States Patent [19]

Battaglia

[11] 4,230,011

[45] Oct. 28, 1980

[54] AUTOMATIC CENTER PUNCH FOR TEMPLATES

[76] Inventor: Luciano Battaglia, 46 Dewlane Dr., Willowdale, Ontario, Canada, M2R 2P8

[21] Appl. No.: 973,740

[22] Filed: Dec. 26, 1978

[51] Int. Cl.[3] ..... B26D 3/08; B26D 7/26; B26F 1/02

[52] U.S. Cl. ..... 83/866; 33/1 M; 33/189; 83/521; 83/522; 83/562

[58] Field of Search ..... 33/1 M, 189; 83/866, 83/562, 868, 522, 521

[56] References Cited

U.S. PATENT DOCUMENTS

| | | | |
|---|---|---|---|
| 1,408,098 | 2/1922 | Knapp et al. | 33/189 |
| 1,615,668 | 1/1927 | Anderson | 33/189 |
| 2,995,826 | 8/1961 | Brault | 33/189 |
| 3,212,194 | 10/1965 | Brault | 33/189 |
| 3,239,941 | 3/1966 | Ahmer | 33/189 |
| 3,384,970 | 5/1968 | Avalear | 33/189 |
| 3,438,133 | 4/1969 | Brault | 33/189 X |
| 3,983,629 | 10/1976 | Scharenberg, Jr. | 33/189 X |
| 4,097,996 | 7/1979 | Yamazawa | 33/1 M |

*Primary Examiner*—J. M. Meister
*Attorney, Agent, or Firm*—Richard L. Miller

[57] ABSTRACT

A machine for production shops to make templates, the machine including a flat base having stops against which a template blank can be rested two tracks going north to south, or vice-versa, along which a first gauge carriage travels ONLY north to south, or vice-versa, and which carries also two tracks moving east to west, in which a second gauge carriage travels; the second gauge carriage also carrying a precision telescopic punch aimed against the template blank.

1 Claim, 4 Drawing Figures

E
16
18a
22
30
31
32
35
11
13
21
20
36
Z
28
13
15
19
25
23
24
17
26
27
18
W
S

AUTOMATIC CENTER PUNCH FOR TEMPLATES

BACKGROUND OF THE INVENTION

This invention relates generally to templates production machinery. A principal object of the present invention is to provide a template centre punching machine of increased precision, by employing two gauges so to locate an exact point on template blank in two planes at right angle to each other.

Further objects of the invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described within the scope of the appended claims.

SUMMARY OF THE INVENTION

Briefly, the invention describes a device in which an automatic centre punch for templates can easily and quickly locate a precise point.

BRIEF DESCRIPTION OF THE INVENTION

Figure 1:
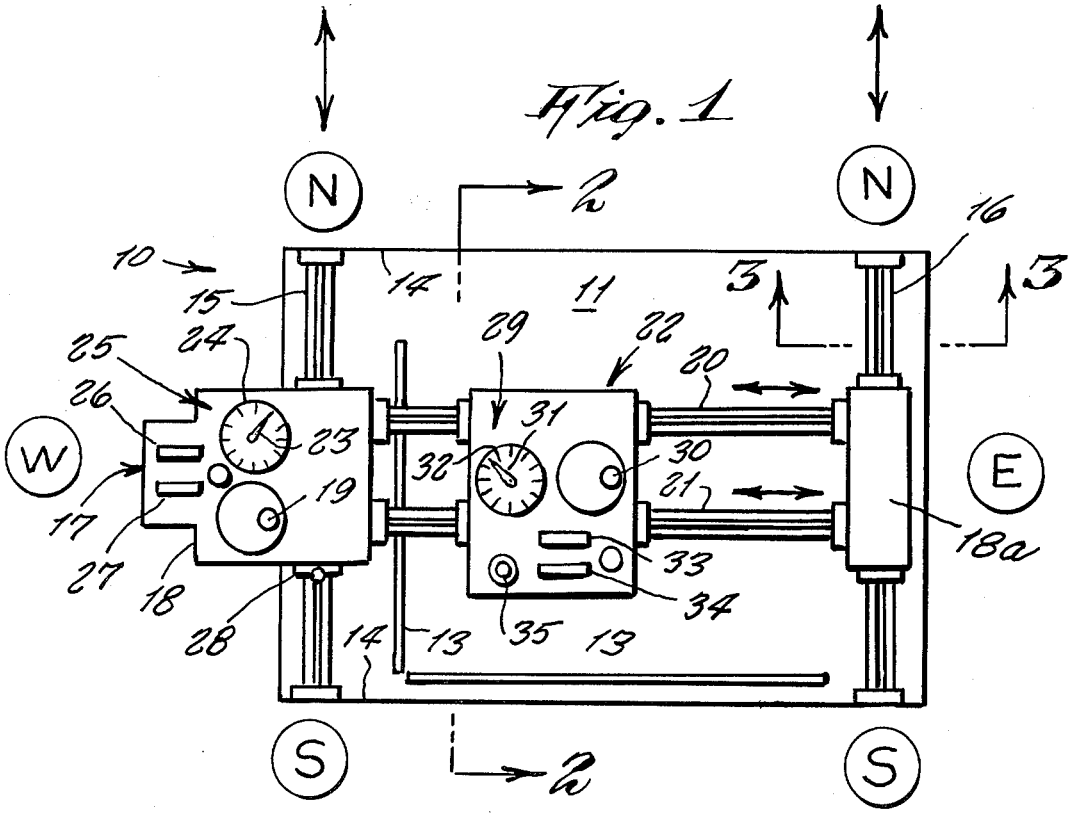
FIG. 1 is a plan view of the invention.
Figure 2:
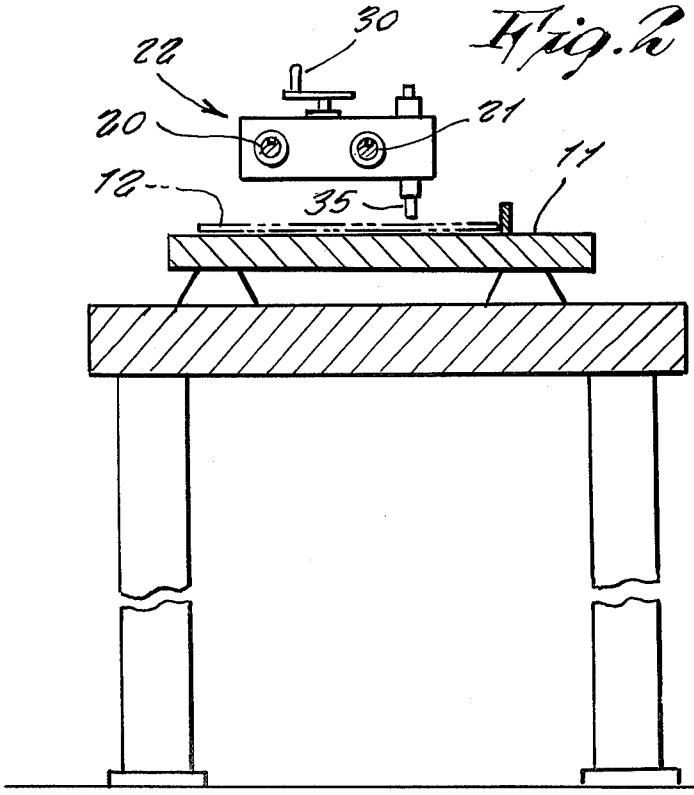
FIG. 2 is a cross-sectional view in direction 2—2 of FIG. 1.
Figure 3:
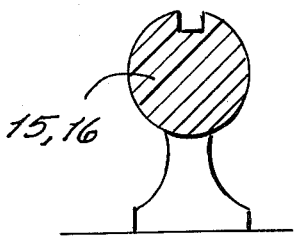
FIG. 3 is an enlarged cross-sectional view taken on line 3—3 of FIG. 1.
Figure 4:
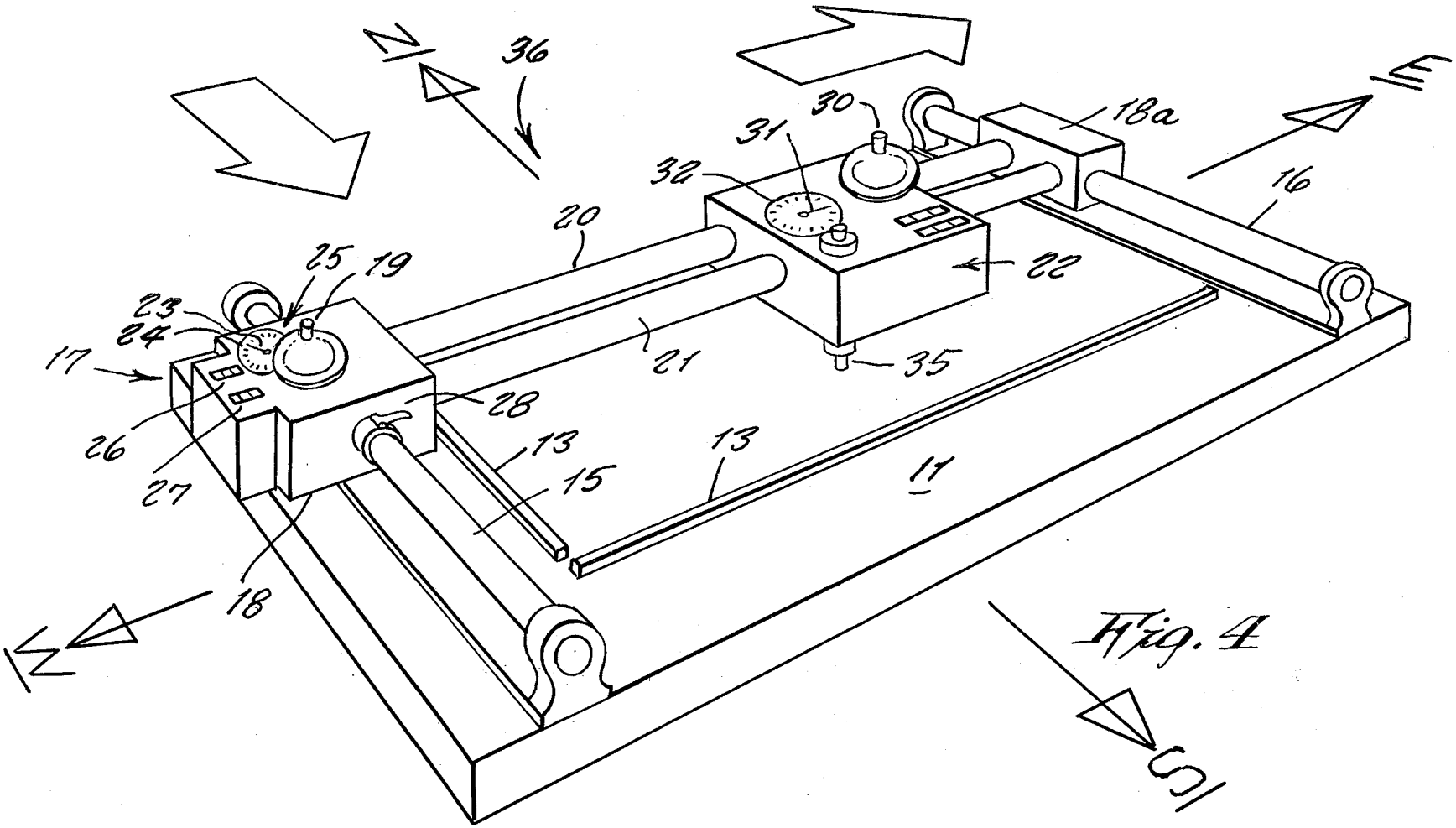
FIG. 4 is a perspective view of the invention.

Referring now to the drawing in greater detail, and more particularly to FIGS. 1 to 4 thereof at this time, the reference numeral 10 represents an automatic centre punch according to the present invention, wherein there is a flat base 11 against which a template blank 12 can be placed so that it rests firmly against stops 13 at right angles to each other and which are affixed to and project forwardly from the base.

The base of the machine supports 2 tracks rails 15 and 16 along which a carriage 17 is slideable in front of the template (north to south or vice-versa).

The carriage 17 includes a guage unit 18 slideable along rail 15 and a guide unit 18*a* slideable along rail 16, the units being rigidly secured together by means of a pair of shafts or rails 20 and 21, that together form a track for a second carriage 22 that is slideable in front of the template, east to west or vice-versa.

The carriage 17 is moveable by means of a crank handle 19 and the elevation of the carriage along the rails is precisely recorded by a needle 23 in front of a dial 24 of the guage 25, and by means of counters 26 and 27 that record the multiples of turns of the needle in front of the dial.

A clamp 28 under the unit 18 serves to rigidly lock the carriage 17 along the track of a selected elevation.

The carriage 22 carries a guage 29 which is similar to the guage 25, except that it records the travel of carriage 22 instead. Accordingly, the east to west or vice-versa guage is likewise operated by a crank handle 30 and includes a needle 31 sweeping in front of a dial 32 and the counters 33 and 34, thus each crank drives a carriage along its respective track.

The carriage 22, however, additionally carries a precision telescopic centre punch 35.

In operation, after a template blank 12 is secured firmly against the stops 13 so to be rigid, the carriage 17 is then elevated to a desired reading of the guage 25, south to north or vice-versa. Thereafter, the carriage 22 is sidewardly moved to a desired reading of the gauge 29, west to east or vice-versa. Then the punch 34 is depressed so to strike a center into the template blank at a precise position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed:

1. An automatic center punch for templates, comprising in combination, a base against which a template blank is positioned, a pair of stops on said base for placement thereagainst by said blank, a first pair of spaced apart rails respectively positioned on opposing sides of said base and forming a track running in a first direction, a first carriage slidable elong one of said rails and a guide unit slidable along the other one of said rails, said first carriage and guide unit rigidly secured together by a second pair of rails forming a track running in a second direction perpendicular to said first direction, a second carriage slidable along said second pair of rails, a precision telescopic punch carried on said second carriage aligned to punch a center in said blank, all four of said rails being substantially identical and being of circular cross section with a notch formed in the top thereof, a crank handle respectively associated with each carriage operating a drive along its respective track for movement of the carriage along its track, a readout gauge respectively associated with each carriage for providing an indication of movement of the carriage along its respective track, and counters for each gauge for counting the number of rotations of a dial within its respective gauge.

* * * * *